US009395119B2

(12) United States Patent
Sanz Garcia et al.

(10) Patent No.: US 9,395,119 B2
(45) Date of Patent: Jul. 19, 2016

(54) ROTARY FURNACE FOR HEAT TREATMENT OF SOLIDS

(75) Inventors: Elena Sanz Garcia, Lyons (FR); Mathieu Rolland, Vernaison (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 742 days.

(21) Appl. No.: 13/263,910

(22) PCT Filed: Mar. 10, 2010

(86) PCT No.: PCT/FR2010/000197

§ 371 (c)(1),
(2), (4) Date: Dec. 29, 2011

(87) PCT Pub. No.: WO2010/116050

PCT Pub. Date: Oct. 14, 2010

(65) Prior Publication Data

US 2012/0094243 A1 Apr. 19, 2012

(30) Foreign Application Priority Data

Apr. 10, 2009 (FR) ..... 09/01.779

(51) Int. Cl.
*F27B 7/16* (2006.01)
*F23G 5/027* (2006.01)
(Continued)

(52) U.S. Cl.
CPC ..... *F27B 7/161* (2013.01); *F23G 5/0273* (2013.01); *F23G 5/20* (2013.01); *F26B 11/045* (2013.01); *F27B 7/34* (2013.01); *F23G 2203/208* (2013.01); *F26B 2200/02* (2013.01)

(58) Field of Classification Search
CPC ..... F27B 7/162; F27B 7/16; F27B 7/28; F23G 5/20; B02C 17/22; B02C 17/06; B02C 17/18; B02C 17/007; B02C 17/04; B02C 17/225; B02C 17/1825; B02C 17/10
USPC ..... 241/181, 183; 432/103, 118, 119
See application file for complete search history.

(56) References Cited

U.S. PATENT DOCUMENTS 1,544,504 A * 6/1925 Tomlinson ..... F27B 7/162 34/142
2,057,526 A * 10/1936 Horton ..... F27B 7/161 34/130

(Continued)

FOREIGN PATENT DOCUMENTS

DE 331069 C 12/1920
DE 4429895 A1 2/1995

(Continued)

OTHER PUBLICATIONS

International Search Report, dated Jun. 8, 2010, issued in corresponding PCT/FR2010/000197.

*Primary Examiner* — Gregory A Wilson
(74) *Attorney, Agent, or Firm* — Millen, White, Zelano and Branigan, P.C.

(57) ABSTRACT

This invention relates to a rotary furnace that is designed for the heat treatment of solids comprising at least one rotary tube (1) into which the solids are introduced and a heating means outside of the rotary tube that makes it possible to conduct the heat treatment, characterized in that the rotary tube comprises—on its inside surface, in contact with the feedstock to be treated—at least 1 heating blade (30, 31, 32, 33, 34, 35, 36, 37, 38).

The invention also relates to the use of this furnace for conducting the roasting of solid biomass.

19 Claims, 5 Drawing Sheets

(51) Int. Cl.

| | |
|---|---|
| ***F23G 5/20*** | (2006.01) |
| ***F26B 11/04*** | (2006.01) |
| ***F27B 7/34*** | (2006.01) |

(56) References Cited

U.S. PATENT DOCUMENTS

| | | | | | |
|---|---|---|---|---|---|
| 2,132,709 | A * | 10/1938 | Vanderwerp | F27B 7/383 | 34/130 |
| 2,939,693 | A * | 6/1960 | Old | F27B 7/162 | 252/378 R |
| 3,676,074 | A * | 7/1972 | Shibayama et al. | C05F 1/02 | 34/122 |
| 4,019,962 | A * | 4/1977 | Allen | B01F 3/04531 | 435/247 |
| 4,136,516 | A * | 1/1979 | Corsmeier | F01D 5/185 | 415/114 |
| 4,286,946 | A * | 9/1981 | Christini | F27B 7/33 | 34/135 |
| 4,288,216 | A * | 9/1981 | Christini | F27B 7/161 | 34/135 |
| 4,354,826 | A * | 10/1982 | Kruger | F26B 3/00 | 432/106 |
| 4,995,809 | A * | 2/1991 | Filges | F26B 11/0477 | 34/136 |
| 5,623,883 | A * | 4/1997 | Davidson | F27B 7/162 | 110/226 |
| 5,702,247 | A * | 12/1997 | Schoof | F27B 7/162 | 432/103 |
| 5,848,755 | A * | 12/1998 | Zickell | B02C 17/04 | 241/171 |
| 5,997,288 | A * | 12/1999 | Adams | C10B 1/10 | 110/226 |
| 5,997,289 | A * | 12/1999 | Dover | F23G 5/20 | 432/103 |
| 7,172,414 | B2 * | 2/2007 | Von Blucher | F27B 7/162 | 241/181 |
| 7,811,083 | B2 * | 10/2010 | Bohringer | C01B 31/088 | 241/181 |
| 7,815,889 | B2 * | 10/2010 | Luan | C04B 11/0283 | 423/636 |
| 8,627,776 | B2 * | 1/2014 | Scheckler | F27D 1/142 | 110/339 |
| 2007/0057411 | A1 * | 3/2007 | Williams | B29B 13/00 | 264/483 |
| 2013/0329515 | A1 * | 12/2013 | Katakura | F27B 7/14 | 366/144 |
| 2014/0054401 | A1 * | 2/2014 | Macinnes | B02C 17/1855 | 241/24.1 |

FOREIGN PATENT DOCUMENTS

| | | | | | |
|---|---|---|---|---|---|
| FR | 2 694 930 | A1 | | 2/1994 | |
| GB | 255569 | A | * | 7/1926 | F27B 7/20 |
| GB | 876211 | A | * | 8/1961 | C21B 13/08 |
| JP | 2009-127946 | A | | 6/2009 | |

* cited by examiner

ROTARY FURNACE FOR HEAT TREATMENT OF SOLIDS

This invention relates to the field of furnaces for heat treatment of solids, and more particularly furnaces for pyrolysis (or thermolysis) or roasting that are designed to treat solids such as wastes of any nature, and, for example, biomass.

Patents that describe rotary furnaces for pyrolysis or thermolysis, such as, for example, the patent FR 2 720 487 that relates to a rotary furnace that is applied to the pyrolysis of wastes in which the radiative transfers are dominant because of higher temperatures (600° C.), are already known. The rotary furnace is a horizontal hollow tube that rotates around its axis of revolution and in which a solid flows. The furnace is slightly inclined, the inlet being higher than the outlet, such that with each revolution, the divided solids rise with the wall and drop a little to the front of their starting point. The speed of rotation and the slope of the furnace are selected to promote the mixing of the feedstock and therefore a homogeneous treatment of each particle.

In this type of device, the heat is primarily provided by the outside of the tube that is heated by circulation of hot gases around the tube (vapor, air, smoke from fuels that are diluted or cooled) or by radiation (electric or flame). The circulation of the gases inside the tube is low to avoid the pneumatic entrainment of particles, which limits the possibilities of transfer by convection. Given the high temperatures to which the furnace is heated, heat transfers to the feedstock are done primarily by radiation rather than by conduction (contact between the feedstock and the heated walls of the furnace).

In the case of the roasting of biomass, the required temperatures (between 220° C. and 400° C.) ensure that the radiative heat transfers are negligible. It is therefore necessary—so as to increase the heat transfer—to increase the transfer by conduction. The transfers by conduction are proportional to the contact surface, to the temperature difference between the feedstock and the wall, and to the thermal conductivity of the feedstock (typically 10-20 $W/m^2/°$ C. for wood). The feedstock/wall temperature difference is limited by the very nature of the lignocellulosic biomass. Beyond a temperature of 280-400° C. in accordance with the gasolines, exothermic reactions begin and are self-sustained by the action of kinetic heat acceleration. These reactions lead to pyrolyzed solids having lost a large amount of their mass and their energy. The loss of yield is significant, and it is necessary to achieve conditions where the exothermic reactions may not have taken place.

For these reasons, the solution that is generally adopted for increasing the transfers is the increase of the length of the rotary furnace for increasing the surface of contact with the biomass. This technique is expensive in terms of investment and energy consumption.

Another solution consists in increasing the dwell time in the furnace by reducing the slope of the furnace and by reducing the flow rate to preserve the same bed height, which leads to a reduction of the capacity.

One solution that makes it possible to improve the mixing of the feedstock during treatment in the furnace and described in, for example, the patent FR 2 467 153, consists in using a helical screw inside the furnace. This screw is fastened on a rotary shaft placed in the center of the furnace. However, although it promotes the mixing of the feedstock, this screw does not make it possible to improve the heating of the feedstock unless it is itself heated from the inside, which is technically difficult and very expensive.

The object of this invention is therefore to remedy one or more of the drawbacks of the prior art by proposing a rotary furnace that makes it possible to improve the heat treatment of solids without a costly investment.

For this purpose, this invention proposes a rotary furnace that is designed for the heat treatment of solids comprising at least one rotary tube into which the solids are introduced and a heating means that is outside of the rotary tube that makes it possible to conduct the heat treatment, characterized in that the rotary tube comprises at least one heating blade 1 on its inside surface, in contact with the feedstock to be treated.

According to one embodiment of the invention, the blade is in the form of a helical propeller that extends over the entire length of the rotary furnace and is oriented along the radial axis of the furnace.

According to another embodiment of the invention, the blade is straight or wavy, with the sine curve that defines the waves being oriented parallel to the longitudinal axis of the furnace.

According to another embodiment of the invention, the blade is in the form of an angle bar or a semi-cylinder.

According to another embodiment of the invention, the blade comprises—at its tip—a straight longitudinal blade that is oriented toward the inside of the furnace.

In one embodiment of the invention, the furnace comprises at least two blades with at least two different heights arranged alternately in such a way that the blades of the same size are not side-by-side.

According to one embodiment of the invention, the furnace comprises between 1 and 100 blades.

According to one embodiment of the invention, the height of the blades is between 20 and 150% of the height of the bed at rest.

According to another embodiment of the invention, at least one blade has a height of between 20% and 150% of the height of the bed at rest in the furnace, and at least one blade has a height that is less than the height.

In one embodiment of the invention, the value of the "height of the bed at rest/by the diameter of the rotary furnace" is between 0.1 and 0.5.

According to one embodiment of the invention, the blades are formed by a corrugated sheet that replaces the inside wall of the furnace, with the waves being parallel to the longitudinal axis of the furnace.

According to another embodiment of the invention, the blades are formed by a semi-corrugated sheet replacing the inside wall of the furnace.

According to one embodiment of the invention, the height of the blades is less than or equal to 0.2 m.

According to one embodiment of the invention, the furnace comprises between 1 and 20 blades per meter.

According to one embodiment of the invention, the blades are made of stainless steel, with or without a coating.

The invention also relates to the use of the rotary furnace according to the invention for conducting the heat treatment of a solid.

According to one embodiment of the invention, the heat treatment is a treatment by roasting solid biomass.

According to one embodiment of the invention, the heat treatment is a non-radiative heat treatment of solids.

BRIEF DESCRIPTION OF THE DRAWINGS

Other characteristics and advantages of the invention will be better understood and will emerge more clearly from reading the description given below by referring to the accompanying figures that are provided by way of example.

The invention relates to a rotary furnace for heat treatment, such as, for example, roasting, of solids, and, for example, wastes such as household, agricultural, and industrial wastes, and solid biomass. The solid biomass that is treated in the device according to the invention can be, for example, lignocellulose (wood, straw, algae), purified lignin, cellulose or a mixture of these different biomasses. The roasting that is done within the scope of the invention consists of a heat treatment that is done at mean temperatures of in general between 80° C. and 400° C., and preferably between 150° C. and 280° C., and in the absence of oxygen.

The furnace according to the invention can be used for non-radiative heat treatments; the feedstock is then primarily heated by conduction.

The rotary furnace is a conventional furnace for thermolysis or pyrolysis as already described in the prior art. The rotary furnace is therefore formed by at least one primary tube into which the feedstock to be treated is introduced, and which is heated by circulation of hot smoke or by electric resistors or by burners that are arranged outside of the tube. The primary tube in general rotates around a longitudinal axis that thus makes possible the mixing of the feedstock and therefore a homogeneous treatment. The tube of the furnace is in general made of steel that may or may not be stainless, with or without a coating.

The primary tube that forms the rotary furnace according to the invention is equipped on its inside surface, i.e., the one that is in contact with the feedstock to be treated, with heating blades. The blades are heated, and in turn heat the feedstock to be treated by transmitting heat. The presence of these blades makes it possible to increase the contact surface of the feedstock to be treated with the wall of the furnace and thus to promote heat exchanges without modifying the length of the furnace or increasing the dwell time of the feedstock in the reactor. These heating blades are heated by conduction of the heat from the tube. For hollow blades (angle bar, for example), it is optionally possible to consider passing hot gases by piercing the tube.

The blades are integral with the tube of the rotary furnace either by welding into the wall of the furnace or by molding during the manufacturing of the furnace, or by replacement of the inside wall of the furnace by a wall that forms the blades, such as, for example, a corrugated sheet. In addition to increasing the surface area, the presence of blades provides a greater rigidity to the furnace.

Figure 3A:
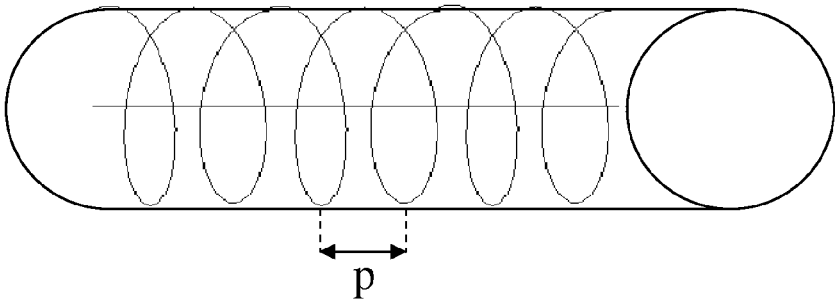
FIG. 3*a* is a diagrammatic representation of a longitudinal cutaway of another variant of the device according to the invention.
Figure 3B:
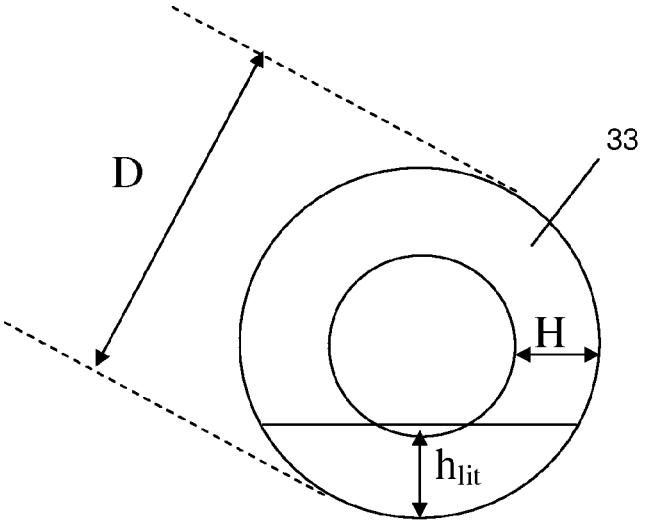
FIG. 3*b* is a diagrammatic representation of a transverse cutaway of the same variant of the device according to the invention.
Figure 4:
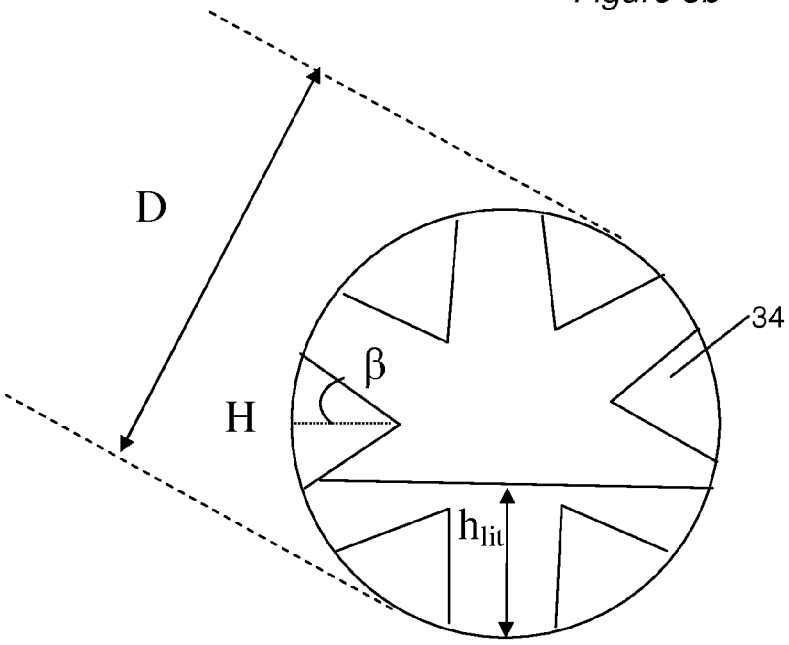
FIG. 4 is a diagrammatic representation of a transverse cutaway of another variant of the device according to the invention.
Figure 5A:
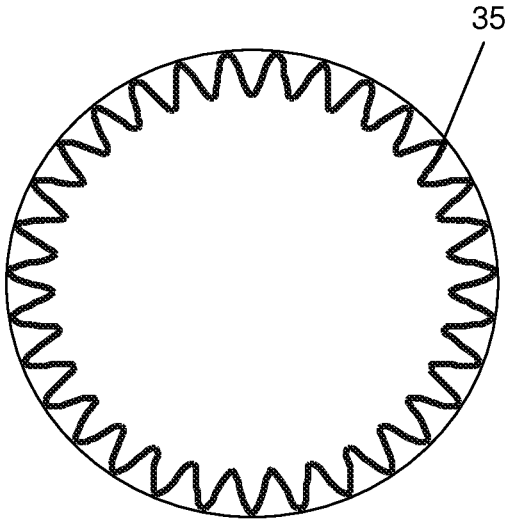
FIGS. 5*a* and 5*b* are diagrammatic representations of a transverse cutaway of two embodiments of another variant of the device according to the invention.
Figure 5B:
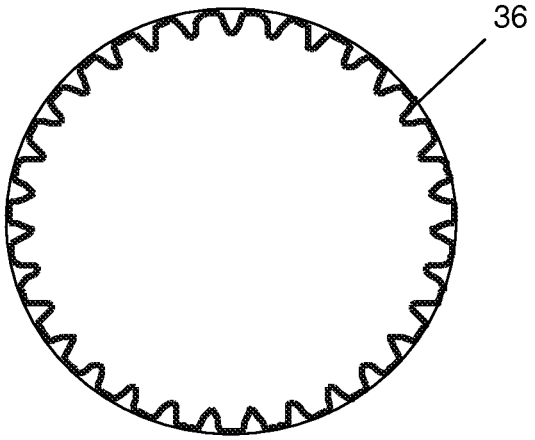
Figure 6:
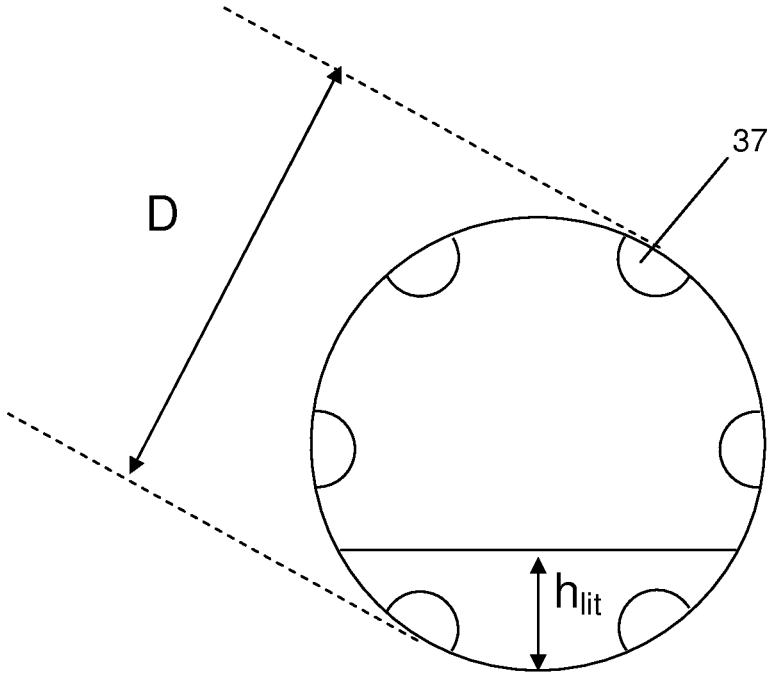
FIG. 6 is a diagrammatic representation of a transverse cutaway of another variant of the device according to the invention.

The blades that are used within the scope of the invention can have different shapes. The shape of the blades can be, for example, straight (FIGS. 1 and 2), wavy (FIG. 8), helical (FIGS. 3*a* and 3*b*), or of a corrugated sheet style (FIGS. 5*a* and 5*b*). It is also possible that the blades have the form of angle bars (FIG. 4), with an angle B that is in general between 15° and 80°, preferably between 30° and 60°, and in a very preferred manner between 40° and 50°. The blades can also have a semi-cylindrical or half-tube shape (FIG. 6). These latter two configurations have the advantage of facilitating the sliding of biomass plates when they are raised up by angle bars or semi-cylinders. The blades can thus be longitudinal angle bars or half-tubes of identical sizes or different sizes or else helical.

Figure 7A:
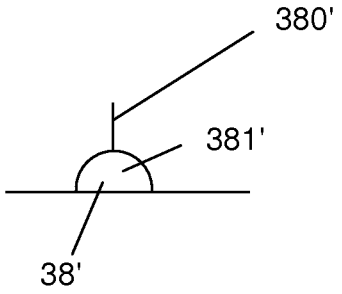
FIGS. 7*a* and 7*b* are diagrammatic representations of a transverse cutaway of two embodiments of another variant of the device according to the invention.
Figure 7B:
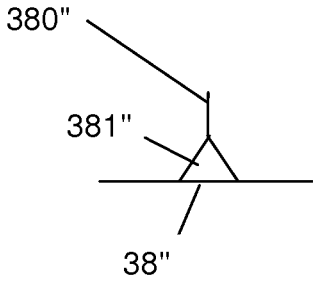

Another blade form is the combination of angle bar or semi-cylinder and straight blade welded on the angle bar or the half-tube (FIGS. 7*a* and 7*b*).

The shape of the blades can also be selected so as to be appropriate to the operating mode of the rotary furnace, for example, rolling, cascade, cataract, centrifuging, etc., in such a way as to promote the transport of particles of the bed and to reduce the dwell time of the feedstock. The blades are to have a shape that prevents the accumulation of particles in the corners for preventing the creation of hot points. They extend over the entire length of the furnace and are oriented along the radial axis of the furnace.

The rotary furnace can comprise between 1 and 100 blades, preferably between 2 and 50, and in a very preferred manner between 4 and 20. In the case of a blade in the form of a corrugated sheet, a wave corresponding to a blade, the number of blades (waves) can be between 1 and 20 per m (with reference to the diameter of the furnace), preferably between 3 and 10 per m, and in a very preferred manner between 4 and 8. The number of blades is in general adapted based on the shape of the blades and the diameter of the tube of the furnace.

The height of the blades, except in the case of blades with a corrugated sheet form, is in general to be between 20% and 150% of the height of the bed at rest ($H_{bed}$) and preferably between 50% and 120%. In the case of blades with a corrugated sheet form, the height is in general less than 20% of the height of the bed at rest ($H_{bed}$). The height of the wavy blades is thus in general less than or equal to 0.2 m, and preferably less than or equal to 0.1 m. The height of the bed at rest corresponds to the height of the feedstock in the rotary furnace when it does not operate. In general, the value of "height of the bed at rest ($H_{bed}$)/diameter (D) of the furnace" is between 0.1 and 0.5, and preferably between 0.2 and 0.3. The filling rate of the furnace is in general between 5 and 50%, and preferably between 10 and 40%.

The blades are in general made of carbon steel or stainless steel, etc., with or without a coating.

Figure 1:
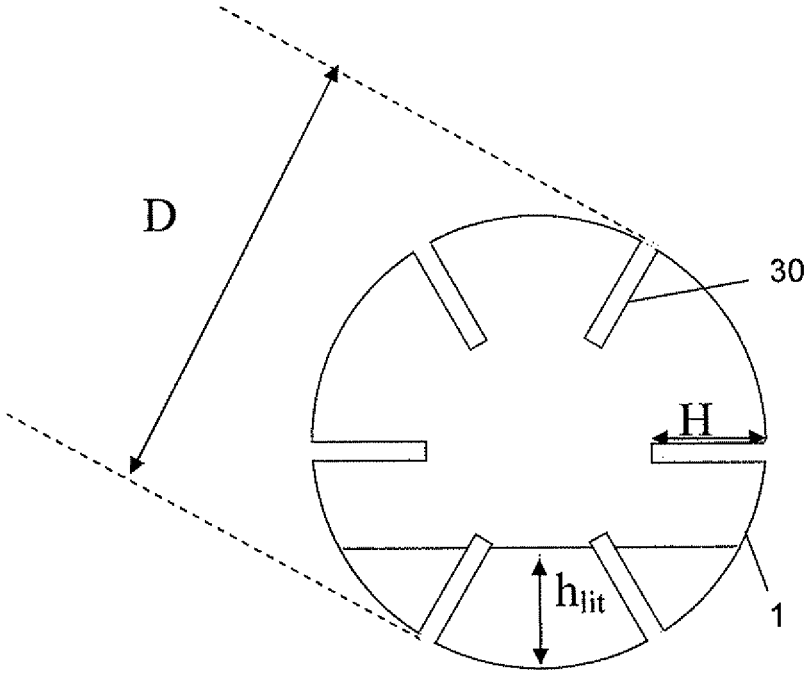
FIG. 1 is a diagrammatic representation of a transverse cutaway of a variant of the device according to the invention.
Figure 8:
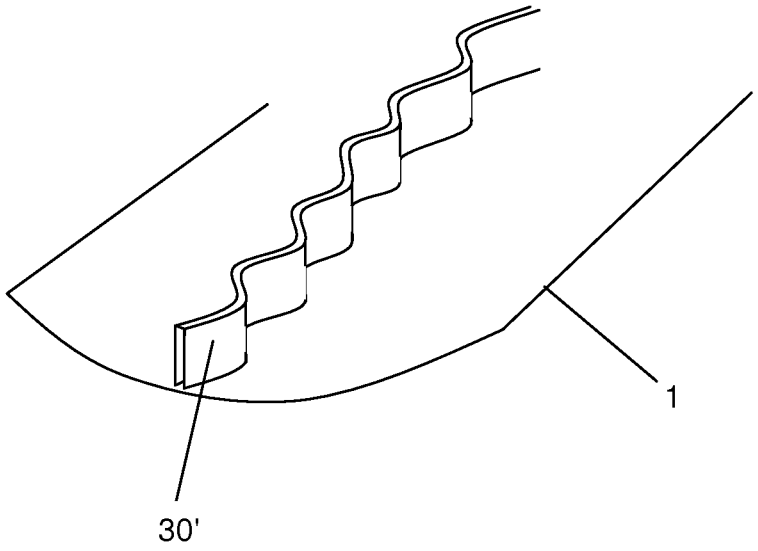
FIG. 8 is a diagrammatic representation of a transverse cutaway of another variant of the device according to the invention.

FIGS. 1 and 8 illustrate the case where the blades (30) are longitudinal (formed by a plate that extends over the entire length of the furnace) and straight (30) or wavy (30'), with the sine curve that defines the waves being oriented parallel to the longitudinal axis of the furnace. Implementation consists in welding the blades into the inside walls of the tube (1) of the furnace. It is also possible to mold the blades directly during the manufacturing of the furnace. The blades are each formed by a plate of the length of the furnace. The longitudinal blades (30, 30') thus extend over the entire length of the furnace. The blades can also be longitudinal and in the form of an angle bar (33) (FIG. 4).

Figure 2:
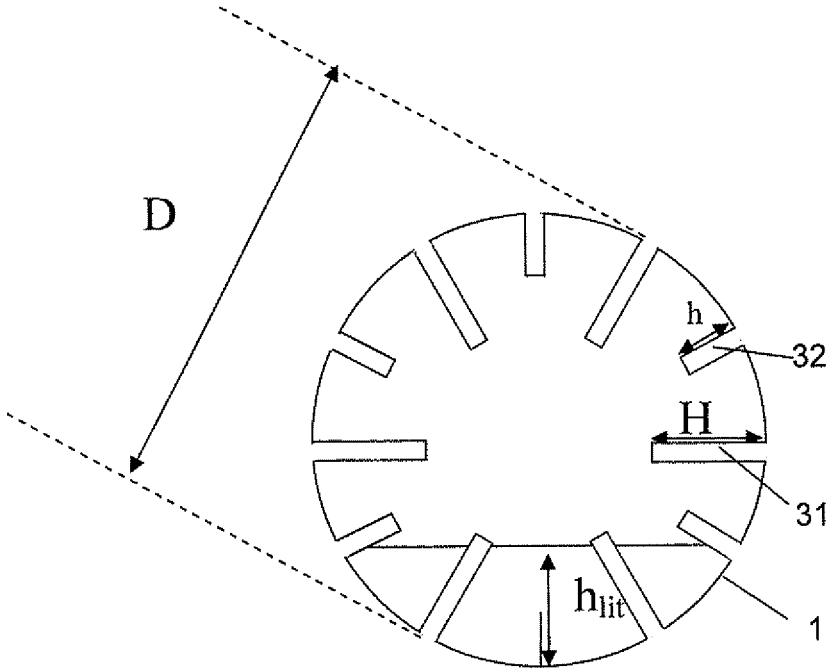
FIG. 2 is a diagrammatic representation of a transverse cutaway of another variant of the device according to the invention.

FIG. 2 illustrates a variant of the invention that uses longitudinal and straight or wavy blades (31, 32) that have different heights (H, h, with h being less than H), and are welded or molded. The blades have a height H (defined above) and a height (h) that is less than (H), with the height (h) being able to be between 1/10 of H and 9/10 of H, preferably between 2/10 of the height (H) and 8/10 of the height (H), and in a very preferred manner between 3/10 of the height (H) and 7/10 of the height (H). The blades (31, 32) of different lengths are used alternately in such a way that the blades of the same size are not side-by side: a taller one, of height (H) (31), and a shorter one, of height (h) (32), and so on. This has the advantage of increasing the number of blades (and therefore the surface that is in contact with the bed) without running the risk of a possible obstruction of the flow of the solid from the inside of the furnace. These blades of different lengths can also be in the form of angle bars (33) or semi-cylinders (37).

FIG. 3 illustrates another variant of the invention in which the blade has a form of helical propeller and is welded into the inside wall of the furnace or molded directly during the manufacturing of the furnace. The propeller is formed by a straight or wavy plate (which also increases the contact surface), with the sine curve that defines the waves being oriented parallel to the longitudinal axis of the furnace, with height (H), and extends over the entire length of the furnace. This has the advantage not only of increasing the surface area but also the transport of solid located in the bed, which is pushed toward the outlet of the tube by the advance of the propeller, at a speed that is equal to the pitch of the propeller p multiplied by the speed of rotation (in $s^{-1}$).

Based on the pitch of the propeller, it is possible to introduce one or more interlocked propellers of the same height or of different heights as defined above. The propellers can also be in the form of angle bars (33) or semi-cylinders (37) or any other forms already described above.

FIGS. 5*a* and 5*b* illustrate a variant where the blades are formed by a wavy wall (35) (FIG. 5*a*) or a semi-wavy wall (the waves have heights that are less than those of the waves of the wavy case) (36) (FIG. 5*b*) replacing the original inside wall of the furnace. The waves or half-waves are parallel to the longitudinal axis of the furnace.

FIG. 6 illustrates a variant of the invention where the blades are in the shape of a semi-cylinder (37) or half-tube of height (H). The rounded part is oriented toward the inside of the furnace, and the semi-cylinders or half-tubes are arranged longitudinally and in parallel to the longitudinal axis of the furnace.

FIGS. 7*a* and 7*b* illustrate a variant of the invention where the shape of the blades (38', 38") is a combination of a blade in the form of an angle bar (380') or semi-cylinder (380") and a straight blade (381', 381"), with the straight blades (381', 381") being welded into the top of the angle bar (380') or the half-tube (380"). The straight parts (381', 381") are thus oriented toward the inside of the furnace.

The following comparison examples illustrate this invention.

EXAMPLE 1

FIG. 1

The blades are longitudinal and straight, welded into the wall of the furnace. For a rotary furnace of diameter (D)=6 m and of length (L)=20 m, with a filling rate of 20% of the volume of the furnace of biomass, and a heat transfer by convection to the inside of the zero bed, the mass flow rates of the feedstock ($Q_m$) calculated with and without blades are:

Without blades, $Q_m$=1.9 t/h

With 6 blades whose height (H)=height of the bed ($h_{bed}$)=0.25*D, $Q_m$=3.8 t/h The presence of 6 blades makes possible an increase of 100% of the mass flow rate relative to the same device without blades.

EXAMPLE 2

FIG. 2

The blades that are used are longitudinal and have two different lengths. For a rotary furnace of diameter (D)=6 m and of length (L)=20 m, with a filling rate of 20% of the volume of the furnace of biomass, and a heat transfer by convection to the inside of the zero bed, the mass flow rates of feedstock that are calculated with and without blades are:

Without blades, $Q_m$=1.9 t/h

With 6 blades of height (H)=$h_{bed}$=0.25*D and 6 blades of height $(H)_{1/2}=h_{bed}/2$, $Q_m$=4.7 t/h The addition of blades with different heights makes possible an increase of 147% of the mass flow rate.

EXAMPLE 3

FIG. 3

The blades that are used are in the form of a helical propeller. For a rotary furnace of diameter (D)=6 m and of length (L)=20 m, with a filling rate of 20% of biomass, and a heat transfer by convection to the inside of the zero bed, the mass flow rates ($Q_m$) of feedstock that are calculated with and without blades are:

Without blades, $Q_m$=1.9 t/h

With 1 blade of height H=$h_{bed}$=0.25*D and not the propeller (ρ)=0.25 m, $Q_m$=5.65 t/h The addition of blades in helical propeller form makes possible an increase of 197% of the mass flow rate.

EXAMPLE 4

FIG. 4

The blades that are used are in the form of a corrugated sheet. For a rotary furnace of diameter (D)=6 m and of length (L)=20 m, with a filling rate of 20% of the volume of the furnace of biomass, and a heat transfer by convection to the inside of the zero bed, the mass flow rates of feedstock calculated for a smooth wall and for a wavy wall are:

Without blades, $Q_m$=1.9 t/h

With a wavy wall whose waves have an amplitude A=0.05 m and a wavelength λ=0.288 (100 periods), $Q_m$=2.9 t/h, with the amplitude A being defined as the distance between the maximum of the wave and the horizontal axis.

The addition of blades in the form of a corrugated sheet makes possible an increase of 52% of the mass flow rate.

EXAMPLE 5

FIG. 5

The blades that are used are in the form of a corrugated sheet. For a rotary furnace of diameter (D)=6 m and of length (L)=20 m, with a filling rate of 20% of the volume of the furnace of biomass, and a heat transfer by convection to the inside of the zero bed, the mass flow rates of feedstock calculated for a smooth wall and for a wavy wall are:

Without blades, $Q_m$=1.9 t/h

With a wavy wall whose waves have an amplitude A=0.02 m and a wavelength λ=0.1 (180 periods), $Q_m$=2.4 t/h.

The addition of blades in the form of a corrugated sheet makes possible an increase of 26% of the mass flow rate.

The use of a rotary furnace that comprises blades according to the invention, regardless of their form, makes it possible to increase the contact surface between the wall of the furnace and the biomass feedstock. This makes possible a better heat transfer by conduction and therefore a reduction of the dwell time in the reactor. The result is an increase of the mass flow rate of the feedstock to be treated or else a reduction of the length of the reactor.

In addition, the blades can promote the movement of the feedstock inside the furnace as well as the mixing of the feedstock and therefore the homogeneity of the final product.

It should be obvious to one skilled in the art that this invention should not be limited to the details provided above and makes possible embodiments in numerous other specific forms without moving away from the field of application of the invention. Consequently, these embodiments should be considered by way of illustration and can be modified without, however, exceeding the scope defined by the claims.

The invention claimed is:

1. A rotary furnace that is designed for heat treatment of solids by conduction of heat in the absence of oxygen, comprising at least one rotary tube (1) into which the solids are introduced and a heater outside of the rotary tube that enables conducting the heat treatment, wherein the rotary tube comprises—on its inside surface, in contact with the feedstock to be treated—at least one heating blade (30, 31, 32, 33, 34, 35, 36) that is integral with the rotary tube (1), heated internally by conduction of the heat from the rotary tube (1), extends over the entire length of the rotary furnace is hollow to permit the internal passing of hot gases via piercing of the tube, and (a) the heating blade (30, 31, 32, 34, 37) is longitudinal, and is oriented along the radial axis of the rotary furnace, or (b) the blade (33) is in the form of a helical propeller that is oriented along the radial axis of the furnace.

2. The rotary furnace according to claim 1, wherein the heating blade (30, 31, 32, 34, 37) is longitudinal, and is oriented along the radial axis of the rotary furnace.

3. The rotary furnace according to claim 2, wherein the blade is straight or wavy, with the sine wave that defines the waves being oriented parallel to the longitudinal axis of the furnace (30, 31, 32).

4. The rotary furnace according to claim 2, wherein the blade is in the form of an angle bar (34) or a semi-cylinder (37).

5. The rotary furnace according to claim 4, wherein the blade (38', 38") comprises—at its tip—a straight longitudinal blade (381', 381") that is oriented toward the inside of the furnace.

6. The rotary furnace according to claim 1, wherein the blade (33) is in the form of a helical propeller that is oriented along the radial axis of the furnace.

7. The rotary furnace according to claim 1, comprising between 1 and 100 blades.

8. The rotary furnace according to claim 1, wherein the blades have a height (H, h) between 20 and 150% of the height of the bed at rest ($H_{bed}$).

9. The rotary furnace according to claim 8, wherein the value of the height of the bed at rest/by the diameter (D) of the rotary furnace is between 0.1 and 0.5.

10. The rotary furnace according to claim 1, wherein the blades (36) are formed by a semi-corrugated sheet that replaces the inside wall of the furnace.

11. The rotary furnace according to claim 1, wherein the blades are made of stainless steel, with or without a coating.

12. A method for conducting heat treatment of a solid, comprising subjecting the solid to a rotary furnace according to claim 1.

13. The method according to claim 12, wherein the heat treatment is a treatment by roasting solid biomass.

14. The method according to claim 12, wherein the heat treatment is a non-radiative heat treatment of solids.

15. A rotary furnace that is designed for heat treatment of solids by conduction of heat in the absence of oxygen, comprising at least one rotary tube (1) into which the solids are introduced and a heater outside of the rotary tube that enables conducting the heat treatment, wherein the rotary tube comprises—on its inside surface, in contact with the feedstock to be treated—at least one heating blade (30, 31, 32, 33, 34, 35, 36) that is integral with the rotary tube (1), heated internally by conduction of the heat from the rotary tube (1), extends over the entire length of the rotary furnace is hollow to permit the internal passing of hot gases via piercing of the tube, having at least two blades (31, 32) with at least two different heights (H, h) that are arranged alternately in such a way that the blades of same size are not side-by-side.

16. The rotary furnace according to claim 15, wherein at least one blade has a height (H) of between 20% and 150% of the height of the bed at rest in the furnace, and at least one blade has a height (h) that is less than the height (H).

17. A rotary furnace that is designed for heat treatment of solids by conduction of heat in the absence of oxygen, comprising at least one rotary tube (1) into which the solids are introduced and a heater outside of the rotary tube that enables conducting the heat treatment, wherein the rotary tube comprises—on its inside surface, in contact with the feedstock to be treated—at least one heating blade (30, 31, 32, 33, 34, 35, 36) that is integral with the rotary tube (1), heated internally by conduction of the heat from the rotary tube (1), extends over the entire length of the rotary furnace is hollow to permit the internal passing of hot gases via piercing of the tube, wherein the blades (35) are formed by a corrugated sheet that replaces the inside wall of the furnace, said corrugated sheet having waves parallel to the longitudinal axis of the furnace.

18. The rotary furnace according to claim 17, wherein the blades have a height that is less than or equal to 0.2 m.

19. The rotary furnace according to claim 17, comprising between 1 and 20 blades per meter.

* * * * *